US007568936B2

(12) United States Patent
Shigemi et al.

(10) Patent No.: US 7,568,936 B2
(45) Date of Patent: Aug. 4, 2009

(54) CABLE CONNECTION GUIDING METHOD AND APPARATUS UTILIZING CONDUCTOR IDENTIFICATION INFORMATION

(75) Inventors: Ryousuke Shigemi, Hitachi (JP); Toshimi Yokota, Hitachiota (JP); Kenji Araki, Mito (JP); Shouzou Komatsu, Hitachinaka (JP); Chikara Takeuchi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 239 days.

(21) Appl. No.: 11/623,378

(22) Filed: Jan. 16, 2007

(65) Prior Publication Data

US 2007/0178742 A1 Aug. 2, 2007

(30) Foreign Application Priority Data

Jan. 16, 2006 (JP) ..... 2006-006885

(51) Int. Cl.
*H01R 13/64* (2006.01)
*H01R 3/01* (2006.01)

(52) U.S. Cl. ..... 439/374; 439/488

(58) Field of Classification Search ..... 439/374, 439/488, 489, 490, 501, 502; 379/442; 385/135; 235/375, 386; 29/749
See application file for complete search history.

(56) References Cited

U.S. PATENT DOCUMENTS

| | | | | |
|---|---|---|---|---|
| 5,394,503 | A * | 2/1995 | Dietz et al. | 385/135 |
| 7,093,351 | B2 * | 8/2006 | Kelley et al. | 29/749 |
| 7,278,572 | B2 * | 10/2007 | Kim et al. | 235/386 |
| 2007/0102505 | A1 * | 5/2007 | Yokota et al. | 235/375 |
| 2008/0253556 | A1 * | 10/2008 | Cobb et al. | 379/442 |

FOREIGN PATENT DOCUMENTS

| | | |
|---|---|---|
| JP | 2003-114247 | 4/2003 |
| JP | 2005-315980 | 11/2005 |
| JP | 2006-054118 | 2/2006 |

* cited by examiner

*Primary Examiner*—Chandrika Prasad
(74) *Attorney, Agent, or Firm*—Antonelli, Terry, Stout & Kraus, LLP.

(57) ABSTRACT

A cable connection guiding method, comprising: extracting first conductor identification information being used to identify first conductor 5 from a radio frequency identification (RFID) tag 4 connected to the first conductor 5 of a cable 3; comparing the first conductor information with a conductor-terminal connection information database, which relates the first conductor identification information for identifying the first conductor 5 to a terminal identification information for identifying a terminal to connect the first conductor 5 and obtaining first terminal identification information for identifying first terminal 2 to be connected to the first conductor 5; and indicating a terminal indicating device 25 associated with the first terminal, according to the first terminal identification information.

4 Claims, 6 Drawing Sheets

CABLE CONNECTION GUIDING METHOD AND APPARATUS UTILIZING CONDUCTOR IDENTIFICATION INFORMATION

CLAIM OF PRIORITY

The present application claims priority from Japanese application serial No. 2006-006885, filed on Jan. 16, 2006, the contents of which is hereby incorporated by reference into this application.

BACKGROUND OF THE INVENTION

1. Field of the Invention

The present invention relates to a guiding method and an apparatus for implementing the method for guiding a worker to a position to which to connect a cable when the cable is connected to a terminal block. Particularly, the present invention relates to a cable connection guiding method and an apparatus for implementing the method that are suitable for cable connection work in a nuclear power station or another facility in which a large number of cables are present.

2. Prior Art

In conventional practice of cable connection to a terminal block in, for example, a control device or device in a nuclear power station, a worker etc. obtains cable connection information, indicating which cable should be connected to which terminal block (which conductor should be connected to which terminal), from paper-based design drawings and/or connection diagrams and uses the obtained cable connection information to connect the cable while conforming the connection.

The specific procedure will be described next. First, a control device is installed in a fixed place, a cable is extended from a cable drum, on which the cable is wound for accommodation, and the extended cable is cut to a necessary length. Cable cards (paper tags) are attached to both ends of the cable, the cable cards including a point from which the cable to be connected starts, a point at which the cable is terminated, and other information. The ends of the cable are then connected to the start point and termination point (terminal blocks) according to the description on the cable cards and cable connection information. When the cable is connected to the terminal blocks, the worker itself obtains the cable connection information from a connection diagram (or the field overseer etc. obtains the cable connection information and indicates the cable connection destinations to the worker), and connects the cable to the prescribed terminal blocks while visually inspecting the start point and termination point based on the description on the cable cards.

[Patent document 1] Japanese Patent Application Laid-open Publication No. 2003-114247

SUMMARY OF THE INVENTION

In the conventional cable connection method, however, it is unavoidable for the worker to rely on paper-based design drawings and cable cards when checking cable connection destinations and the like. Accordingly, various types of confirmation during cable connection include visual inspection by the worker. The resulting cable connection work involves much labor, increasing work time. This type of problem is particularly remarkable when a large number of cables (conductors) and terminal blocks to which the cables are connected are present as in a nuclear power station.

An object of the present invention is to provide a cable connection guiding method and an apparatus for implementing the method that eliminates visual inspection by use of paper-based design drawings, cable cards, and other materials to support cable connection.

A cable connection guiding method, comprising: extracting first conductor identification information being used to identify first conductor from a radio frequency identification (RFID) tag connected to the first conductor of a cable; comparing the first conductor information with a conductor-terminal connection information database, which relates the first conductor identification information for identifying the first conductor to a terminal identification information for identifying a terminal to connect the first conductor and obtaining first terminal identification information for identifying first terminal to be connected to the first conductor; and indicating a terminal indicating device associated with the first terminal, according to the first terminal identification information.

When connecting cables to terminal blocks, visual inspection, in which paper-based drawings, cable cards, and the like are used, by a worker can be eliminated.

DETAILED DESCRIPTION OF THE INVENTION

Figure 1:
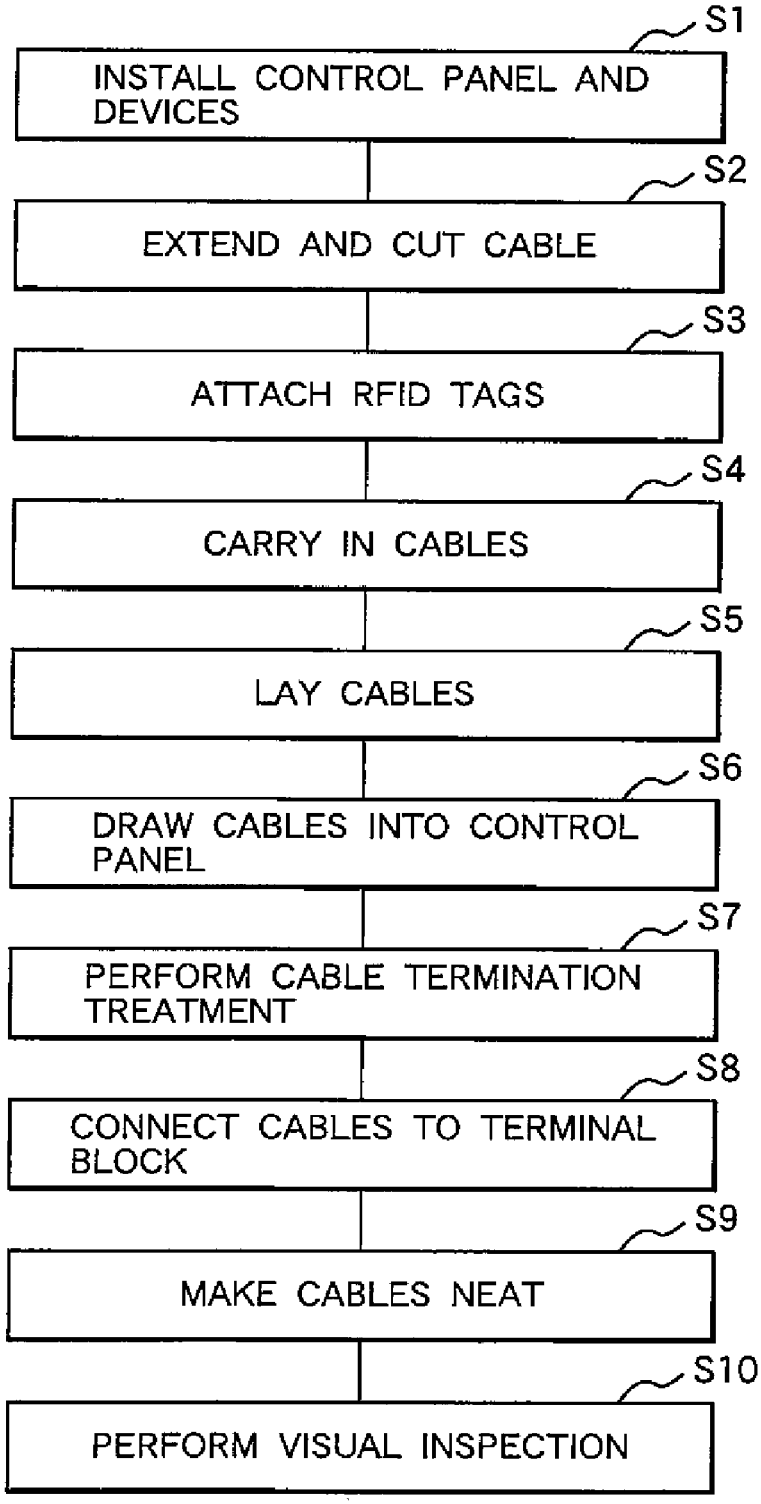
FIG. 1 is a flowchart to show a work procedure in the first embodiment of the present invention.

A cable connection guiding method and an apparatus for implementing the method according to the present invention will be described in detail with reference to the drawings.

EMBODIMENT 1

A control panel 1 in this embodiment of the present invention is a cabinet that includes operation switches for controlling the operations of the devices in a nuclear power station or the like, a monitor or recorder, and other controls. A device 11 is a valve disposed in a pipe in which steam or other fluid flows in the nuclear power station, an air-conditioner, a heat exchanger, a heater, a measuring instrument, or another device. A terminal 2 is a part that becomes a termination point when a cable is connected to the control panel 1 or the like. A terminal block 21 has a plurality of terminals 2 and is disposed in the control panel 1 or the like. In the control panel 1 or the like, wires called insulated wires are used to make connections among instruments, switches, and lamps and between the terminal block 21 and these components. Each insulated wire is structured by covering a conductor, through which electricity flows, with an insulating body such as a polyethylene material. Unlike the interior, the exterior of the control panel 1 may be damaged, so the insulated wire is further protected by a polyethylene material or the like. A cable is formed by covering a plurality of protective layers of this type (insulated wires, that is, insulated conductors) together with a sheath.

Embodiment 1 of the present invention will be described with reference to FIGS. 1 to 5. In this embodiment, RFID tags 4 or the like are used to support connection work by a worker when a conductor 5 in a cable 3 is connected to terminals 2 in the control panel 1 and device 11.

FIG. 1 is a flowchart to show a work procedure in this embodiment of the present invention. This embodiment will be described with reference to the flowchart. First, the control panel 1 and devices 11 are installed in place in the nuclear power station (S1). Then (or in parallel to S1), cables 3 are extended from cable drums outdoors or in another place and cut the cables 3 to a necessary length (S2).

RFID tags 4 are connected to both ends of each conductor 5 in each cable 3 (S3). The each cable 3 includes a plurality of conductors 5; when all conductors 5 are connected to terminals 2 on the terminal block 21 disposed in the control panel 1, the cable 3 can be connected to the terminal block 21. The RFID tag 4 connected to the conductor 5 includes at least identification information (referred to below as conductor identification information 61) specific to the conductor 5, which discriminates the conductor 5 from other conductors as well as identification information (referred to below as terminal identification information 62) about the terminal 2 to which to connect the conductor 5. The RFID tag 4 may further include cable identification information for identifying the cable 3 to which the conductor 5 belongs, terminal block identification information for identifying the terminal block to which the terminal belongs, control panel identification information for identifying the control panel, and other information.

Next, the cables 3 are carried into a building in the nuclear power station (S4) and laid in place (S5). Specifically, the cables 3 are brought into a building and laid toward the start point (for example, the control panel 1) and the termination point (for example, the device 11), starting from the midpoint between the start and termination points. Each cable 3 is laid by passing it through a cable tray, a wire pipe, or another cable accommodation device (wire path) disposed on the laying path. Upon the completion of the laying of the cable 3, the cable is drawn into the control panel 1 (S6). The drawn cable 3 (conductors 5) undergoes terminal treatment before it is connected to the terminal block 21 (S7).

Figure 2:
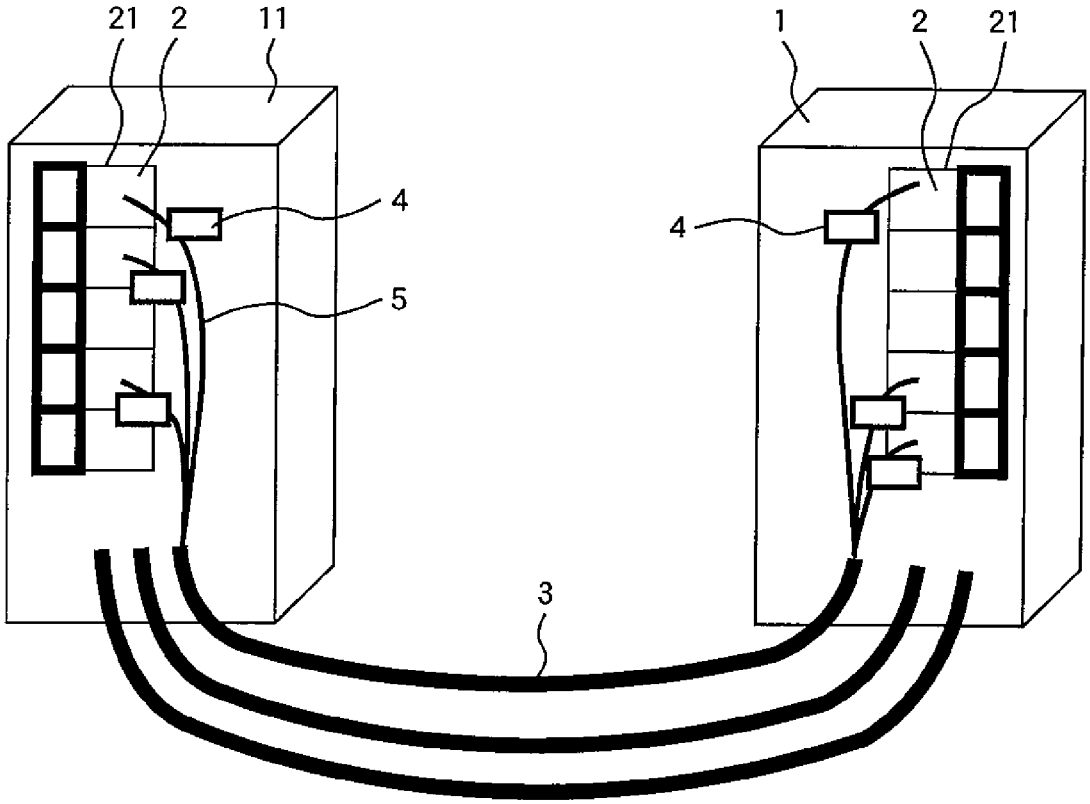
FIG. 2 is a schematic drawing to show a connection of cables between a control panel and a terminal block in the first embodiment of the present invention.
Figure 3:
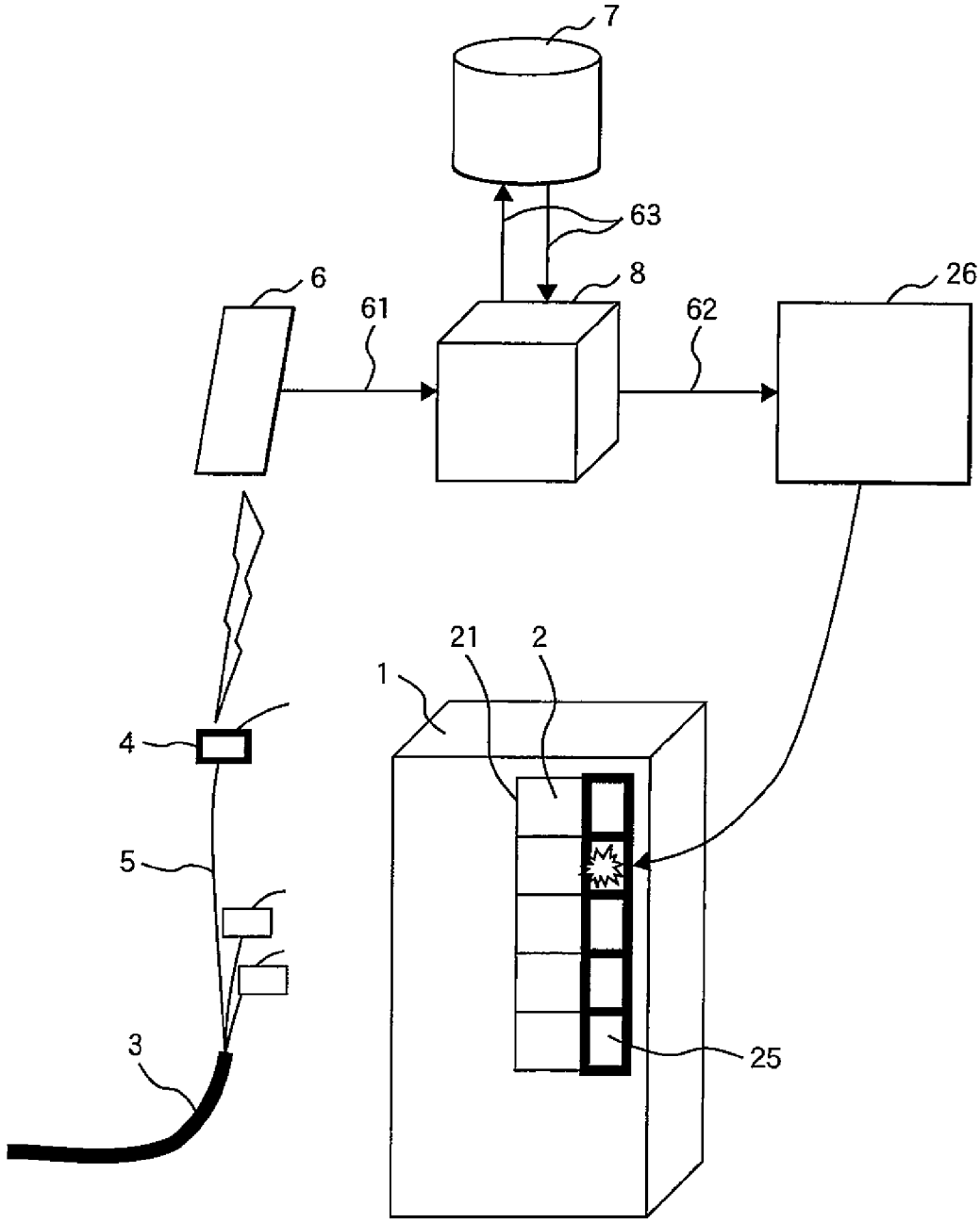
FIG. 3 is a schematic drawing to show a connection work guiding system in the first embodiment of the present invention.
Figure 4:
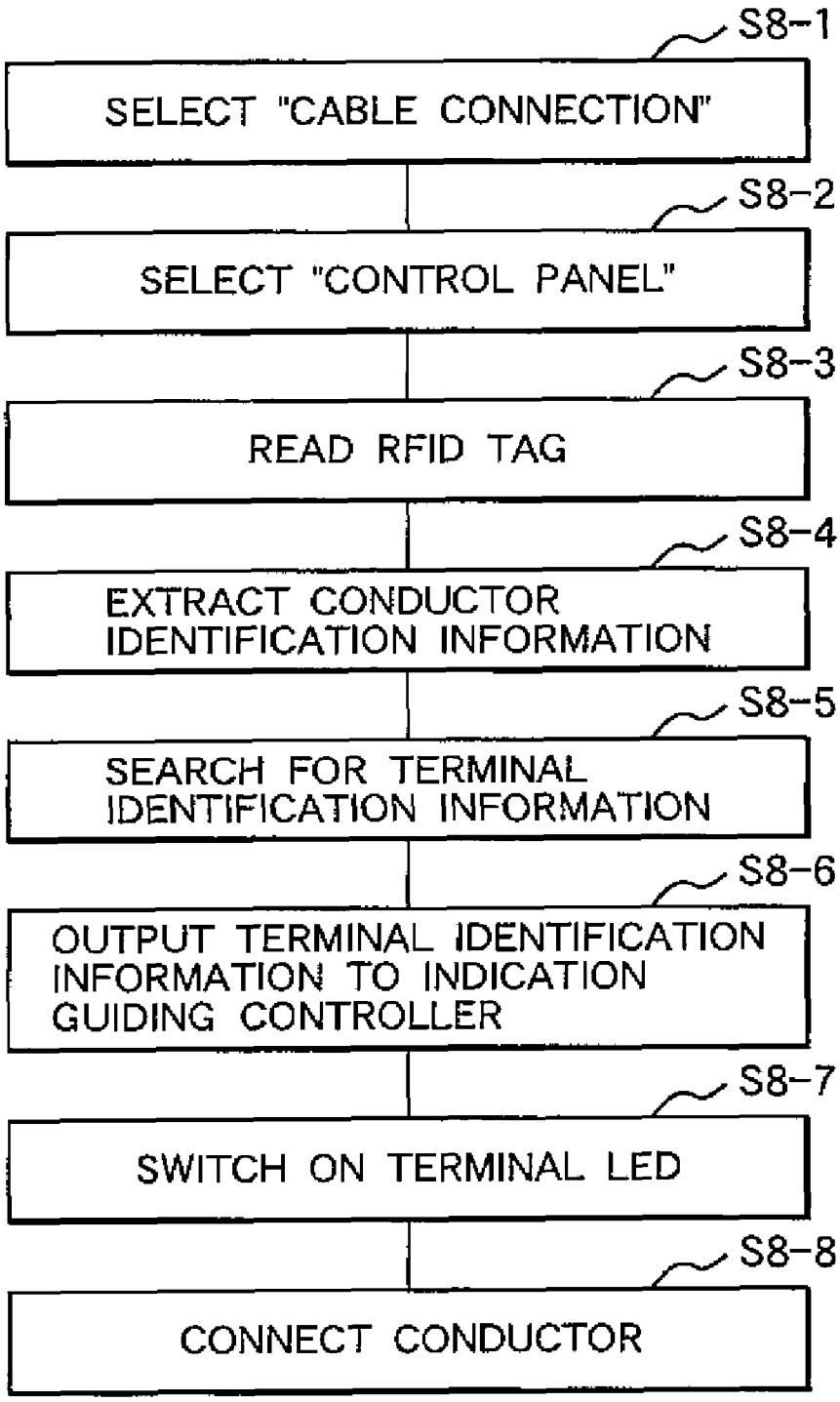
FIG. 4 is a flowchart to show a work procedure for connecting a cable to a terminal block in the first embodiment of the present invention.

Each conductor 5 in the cable 3 is connected to target terminals 2 in the control panel 1 and device 11 (S8). FIG. 2 is a schematic drawing to show the connection of the cables 3 between the terminal blocks 21 of the control panel 1 and device 11 in the embodiment 1 of the present invention. One end of each conductor 5 in each cable 3 is connected to a terminal 2 on the terminal block 21 in the control panel 1, and the other end of the conductor 5 in the cable 3 is connected to a terminal 2 on the terminal block 21 in the control device 11. FIG. 3 is a schematic drawing to show a connection work guiding system in this embodiment of the present invention. FIG. 4 is a flowchart to show a work procedure for connecting a cable to a terminal block in the embodiment 1 of the present invention; it describes step S8 in FIG. 1 in detail.

Work for connecting the conductor 5 to the terminal 2 in the control panel 1 will be described below with reference to the flowchart in FIG. 4. The worker has a reader 6 for reading information from the RFID tags 4 and mobile terminal equipment 8 for, for example, sending fixed information.

First, the worker selects "Cable connection" from the work items displayed on the mobile terminal equipment 8 carried by the worker (S8-1). "Control panel number" is indicated on the mobile terminal equipment 8 responsive to the selection of "Cable connection". The worker selects the number of the control panel 1 to which to connect the cable 3 (S8-2) The worker then reads the information from the RFID tag 4 connected to the conductor 5 in the cable 3 by use of the reader 6 (S8-3). The information read from the RFID tag 4 is sent to the mobile terminal equipment 8, and the conductor identification information 61 about the conductor 5 is extracted from the RFID tag 4 (S8-4).

Next, the terminal identification information 62 about the terminal 2 to which to connect the conductor 5 is obtained from the conductor identification information 61 (S8-5). Specifically, data is read from databases (referred to below as the back diagram databases 7), each of which includes a back diagram (design drawing that describes connection information about the terminal blocks 21 in the control panel 1 and device 11); the back diagram has a conductor-terminal connection information database that has been created in relation to connection information (referred to below as the conductor-terminal identification information 63), which is related to the conductor identification information 61 and the terminal identification information 62, indicating that which conductor 5 is connected to which terminal 2. The conductor identification information 61 extracted in S8-4 is compared with the back diagram databases 7 (conductor-terminal connection information databases) so as to obtain the terminal identification information 62 about the terminal 2 to which to connect the conductor 5. That is, the conductor identification information 61 is used as a key to search for the back diagram database 7 (conductor-terminal connection information database) for the terminal identification information 62 about the terminal 2 to which to connect the conductor 5.

All back diagram databases 7 do not need to be read; it is possible to read only the back diagram database 7 corresponding to the number of the control panel 1. It is also possible that if there is no terminal identification information 62 corresponding to the control panel 1 selected by the worker, an error message is output from the mobile terminal equipment 8 or another unit to notify the worker or another person.

The terminal identification information 62 obtained in S8-5 is then output to an indication guiding controller 26 (S8-6). Upon the reception of the terminal identification information 62 from the processing unit 8, the indication guiding controller 26 switches on a light or indicates the indication device associated with the terminal 2 to which to connect the conductor 5 (S8-7). An LED (referred to below as the terminal LED 25), for example, may be used as the indication device. Light emitted from the terminal LED 25 enables the worker to ascertain the position of the terminal 2 to connect.

Figure 5:
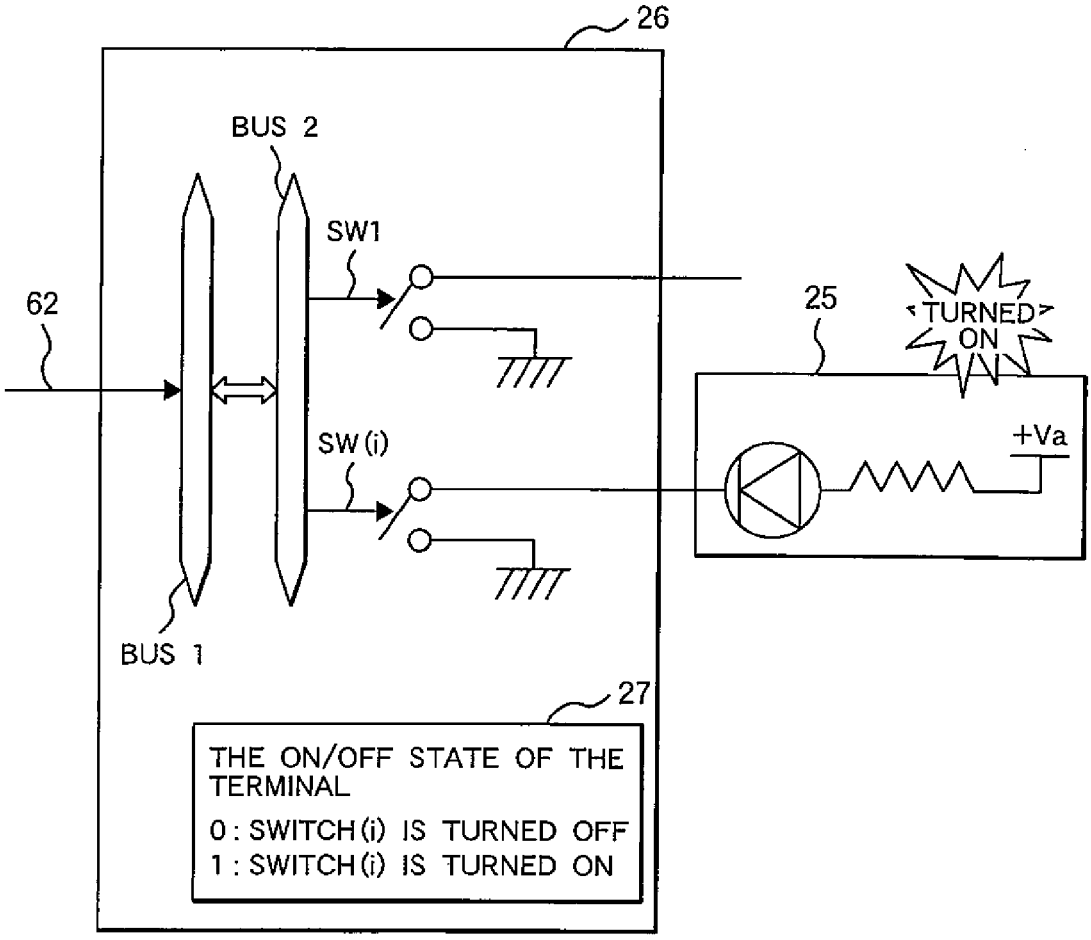
FIG. 5 is a detailed drawing of a LED controller as an indication device in the first embodiment of the present invention.

An LED controller 26 in which an LED is used for an indication device as the indication guiding controller 26 will be now described. FIG. 5 shows the structure of the LED controller as the indication guiding controller 26 in detail. The information string indicating the on/off states (0/1, 0/1, . . . , 0/1) of the terminal 2 can be used as the terminal identification information 62. When an i-th element in the information string, which is the terminal identification information 62 entered, is 0, a switch control unit 27 turns off sw(i); the terminal LED 25 attached to the terminal does not emit light. When the element is 1, the switch control unit 27 turns on sw(i), causing the terminal LED 25 attached to the terminal to emit light. As a result, the LED 25 attached to the terminal 2 to which to connect the cable 3 (conductors 5) is turned on, so the conductor 5 can be connected to the prescribed terminal 2 without the worker having to perform visual inspection through the paper-based design drawings, cable cards, and other materials.

Then, the worker connects the conductor 5 of the cable 3 to its target terminal 2 on the terminal block 21 with a screwdriver or another tool, according to the indication by the indication device (turned-on state of the terminal LED 25) (S8-8). The same work is performed for other terminals 2 in the control panel 1 and terminals 2 in the device 11. After all connection work is completed for the control panel 1 and device 11, the state of the cable 3 laid is made neat in consideration of the appearance around the terminal blocks 21 (S9). Visual inspection is then performed for the cable 3 and all conductors 5 (S10). This completes the work of laying and connecting the cable.

The data in the back diagram of the back diagram database 7 can include number of control panel 1, number of terminal block 21, number of terminal 2, number of cable 3, and number of conductor 5. Information as to whether the conductor 5 is currently connected to the terminal 2 (connected, 1) or not (unconnected, 0) can also be included. That is, after the conductor 5 has been connected to the prescribed terminal 2, when, for example, the worker, for example, selects a connection work completion button from the mobile terminal equipment 8, connection work completion information is sent to the processing unit 8 and added to the back diagram in the back diagram database 7. Accordingly, a progress status, which indicates which work has been completed, can be registered.

If the length of the cable 3 is shortened during the work at the cable laying site, the RFID tag 4 can be reconnected according to the shortened length of the cable 3.

In this embodiment, when a cable 3 is connected to a terminal block 21, conductors 5 can be connected to prescribed terminals 2 without the worker having to perform visual inspection by use of the paper-based design drawings, cable cards, and other materials, so time taken in cable connection work can be lessened. This embodiment is particularly effective when there are a large number of cables (conductors) and terminals as in a nuclear power plant.

Since the worker can connect a cable 3 to a terminal block 21 without having to view design drawings and other materials (the necessity of check by the work itself can be eliminated), reliability is improved from the viewpoint of preventing incorrect connections due to human errors.

EMBODIMENT 2

Figure 6:
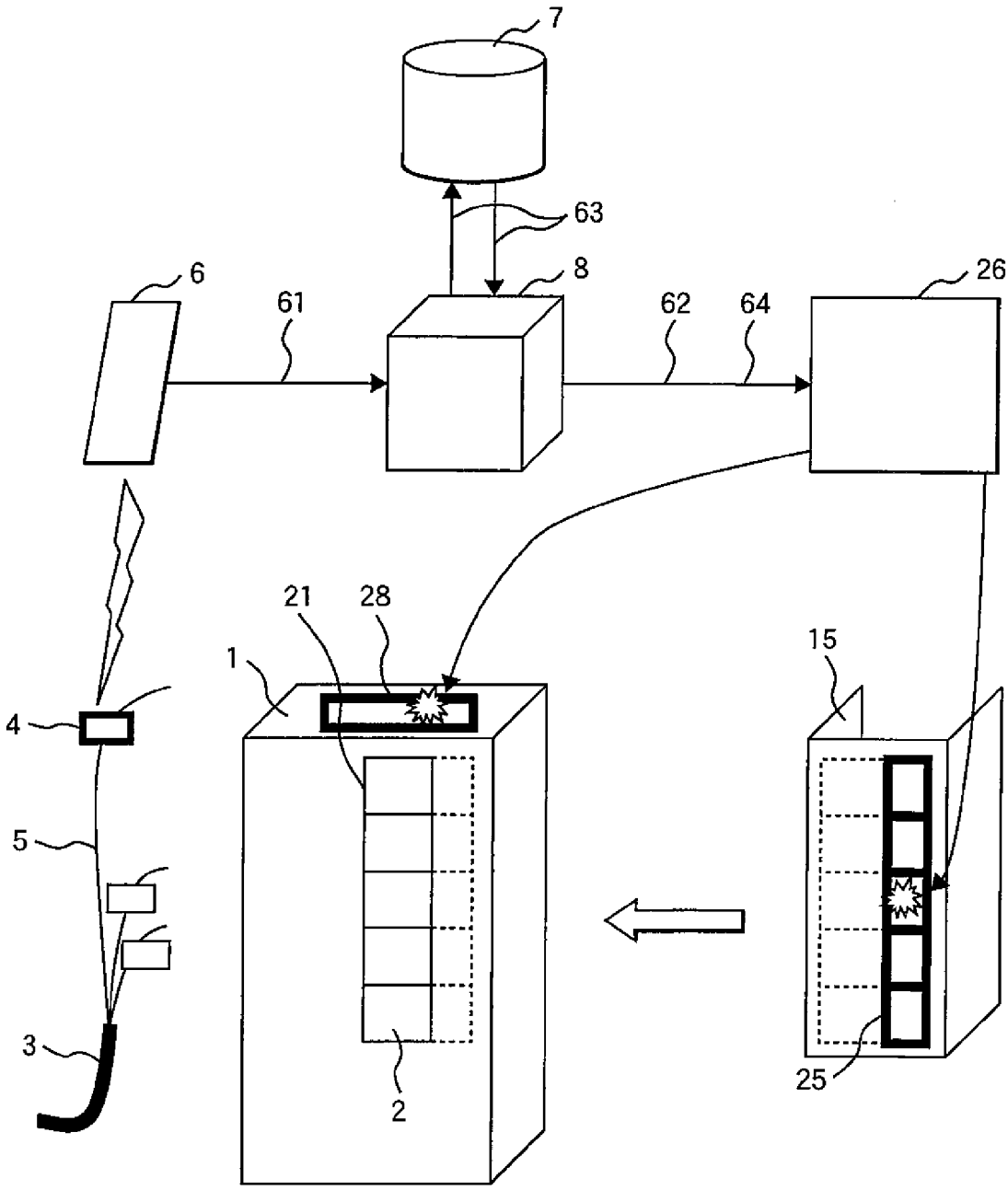
FIG. 6 is a schematic drawing to show a connection work guiding system in the second embodiment of the present invention.

In this embodiment of the present invention shown in FIG. 6, when a conductor 5 included in the cable 3 is connected to the control panel 1 and device 11, RFID tags 4 or the like are used to support connection work by the worker, as in the embodiment 1 of the present invention. However, a terminal indicating device (terminal LED 25) for identifying a terminal 2 is not directly disposed on the terminal block 21, but disposed on a terminal block cover 15 attached to the terminal block 21. The terminal block cover 15 is fabricated in a standard manner, assuming that the specifications (the number of connection points, dimensions, etc.) of the terminal blocks 21 in the control panel 1 and device 11 are common, so the terminal cover 15 can be attached to a plurality of terminal blocks 21.

FIG. 6 schematically shows how the cable 3 is connected to the terminal block 21 in the control panel 1 when the terminal block cover 15 is used. This embodiment will be described below with reference to FIG. 6. However, this embodiment is the same as the embodiment 1 in that the RFID tag 4 having the conductor identification information 61, the back diagram databases 7 (conductor-terminal identification information 63) having data by which the conductor identification information 61 and terminal identification information 62 are related, and the indication guiding controller 26 or the like for switching on a light or indicating a prescribed indication device are used to notify the worker of a terminal 2 to which to connect a conductor 5 so as to support connection work by the worker, so detailed description about the support method will be omitted; only differences from the embodiment 1 will be described.

First, as in the embodiment 1, the conductor identification information 61 is extracted from the information read from the RFID tag 4 connected to the conductor 5. The terminal identification information 62 about the terminal 2 to which to connect the conductor 5 is obtained from the extracted conductor identification information 61 and conductor-terminal identification information 63. However, in addition to the identification information about the terminal 2, the terminal identification information 62 in this embodiment includes identification information (referred to below as the terminal block identification information 64) about the terminal block 21 to which to connect the conductor 5. The indication guiding controller 26 switches on a light or indicates the terminal block indication device 28 mounted on the terminal block 21 to which to connect the conductor 5, according to the terminal block identification information 64. As the terminal block indication device 28, an LED can be used, for example. When the terminal block indication LED 28 is switches on a light or indicated, the worker can be notified that the conductor 5 should be connected to which terminal block 21 (the terminal block cover 15 should be attached to which terminal block 21).

The worker then attaches the terminal block cover 15, on which terminal indicating devices (such as terminal LEDs 25 are mounted, to the terminal block 21 on which the terminal block LED 28 has switched on a light or indicated, according to the indication of the terminal block LED 28. The terminal block cover 15 is attached in such a way that it covers the surface on which the terminals 2 on the terminal block 21 are disposed.

After the terminal block cover 15 has been attached to the terminal block 21, the conductor identification information 61 is read again from the RFID tag 4 by use of the reader 6 to obtain the terminal identification information 62 about the terminal 2 to which to connect the conductor 5 from the read conductor identification information 61 and the conductor-terminal identification information 63. The indication guiding controller 26 switches on a light or indicates the terminal LED 25 associated with the terminal 2 to which to connect the conductor 5, according to the terminal identification information 62. The lit terminal LED 25 enables the worker to ascertain the terminal 2 to which to connect the conductor 5.

Each terminal LED 25 on the terminal block cover 15 is disposed in a position corresponding to its associated terminal 2 on the terminal block 21. Accordingly, when an LED 25 on the terminal block cover 15 is switched on a light or indicated, the worker can ascertain the terminal 2 to which to connect the conductor 5.

When the worker finishes the connection work of the cable 3 (conductors 5) for a terminal block 21 and shifts to the connection work for another terminal block, the worker removes the terminal block cover 15 from the terminal block 21 for which the connection work is completed and attaches the terminal block cover 15 removed to the other terminal block so that cable connection is guided as described above.

In this embodiment, after the terminal block cover 15 has been attached to the terminal block 21, the conductor identification information 61 is read again from the RFID tag 4 by use of the reader 6 to obtain the terminal identification information 62 about the terminal 2 to which to connect the conductor 5 from the read conductor identification information 61 and the conductor-terminal identification information 63. However, the indication guiding controller 26 may switch on a light or indicate the terminal LED 25 according to the terminal identification information 62 obtained first, without waiting for a command from the worker (without obtaining the conductor identification information 61 again from the worker) when the terminal block cover 15 is attached to the terminal block 21 (attachment of the terminal block cover 15 to the terminal block 21 is used as a trigger).

When the terminal block 21 to which to connect conductors 5 is known, there is no need to switch on a light or indicate the terminal block LED 28; the terminal block cover 15 can be attached in advance to a prescribed terminal block 21 and then connection work of connecting the conductors 5 can be performed.

The same effect as in the embodiment 1 can be obtained in this embodiment as well. Since a terminal block cover 15 formed in a standard manner is used, it can be used for a plurality of terminal blocks 21, and thereby a guiding apparatus on which terminal LEDs are mounted does not need to be prepared for all terminal blocks 21, reducing costs in cable connection work.

What is claimed is:

1. A cable connection guiding method, comprising the steps of:

extracting conductor identification information being used to identify a conductor from a RFID tag connected to the conductor of a cable, comparing the extracted conductor identification information with a conductor-terminal connection information database, which relates the conductor identification information for identifying the conductor to a terminal identification information for identifying a terminal to be connected to the conductor, and obtaining the terminal identification information for identifying the terminal to be connected to the conductor; and indicating a terminal indicating device associated with the obtained terminal, according to the terminal identification information.

2. A cable connection guiding method, comprising the steps of:

disposing a terminal block cover having an indication device corresponding to a position of each terminal to be connected to each conductor of a cable to cover a terminal block on which a plurality of the terminals are aggregated, extracting conductor identification information being used to identify a conductor from a RFID tag connected to the conductor of the cable, comparing the conductor identification information with a conductor-terminal connection information database, which relates the conductor identification information for identifying the conductor to terminal identification information for identifying a terminal to be connected to the conductor, and obtaining the terminal identification information for identifying the terminal to be connected to the conductor; and indicating a terminal indicating device mounted on the terminal block cover associated with the terminal, according to the terminal identification information.

3. A cable connection guiding apparatus, comprising:

a reader for reading out conductor identification information from an RFID tag connected to a conductor of a cable, the conductor identification information being used to identify the conductor;

a conductor-terminal connection information database, which relates the conductor identification information for identifying the conductor to a terminal identification information for identifying a terminal to be connected to the conductor;

a device for comparing the conductor identification information with the conductor-terminal connection information database so as to obtain the terminal identification information for identifying the terminal to be connected to the conductor; and an indication guiding controller for indicating a terminal indicating device associated with the first terminal, according to the terminal identification information.

4. A cable connection guiding apparatus according to claim 3, further comprising a terminal block cover disposed to cover a terminal block having the terminal, wherein the terminal block cover is provided with the terminal indicating device mounted in position corresponding to the terminal on the terminal block.

* * * * *